US005498515A

United States Patent [19]

Merkel et al.

[11] Patent Number: 5,498,515

[45] Date of Patent: Mar. 12, 1996

[54] PHOTOGRAPHIC ELEMENT CONTAINING A CERTAIN SULFONATED ACYLACETANILIDE COUPLER IN COMBINATION WITH LOW- OR NON-CHLORIDE EMULSIONS

[75] Inventors: Paul B. Merkel; Jerrold N. Poslusny, both of Rochester, N.Y.; Hugh M. Williamson, Hanwell, United Kingdom; Bernard A. Clark, Maidenhead, United Kingdom; Paul L. R. Stanley, Harrow, United Kingdom

[73] Assignee: Eastman Kodak Company, Rochester, N.Y.

[21] Appl. No.: 214,866

[22] Filed: Mar. 17, 1994

[51] Int. Cl.[6] ..... G03C 1/035; G03C 7/36

[52] U.S. Cl. ..... 430/556; 430/557; 430/567

[58] Field of Search ..... 430/556, 557, 430/567, 544

[56] References Cited

U.S. PATENT DOCUMENTS

| | | | |
|---|---|---|---|
| 3,973,968 | 8/1976 | Fujiwhara et al. | 96/56.5 |
| 4,022,620 | 5/1977 | Okumura et al. | 96/56.5 |
| 4,026,706 | 6/1974 | Nakamura et al. | 96/74 |
| 4,693,964 | 9/1987 | Daubendick et al. | 430/505 |
| 4,871,658 | 10/1989 | Sakamoto et al. | 430/567 |
| 5,066,574 | 11/1991 | Kubota et al. | 430/557 |
| 5,272,048 | 12/1993 | Kim et al. | 430/503 |

FOREIGN PATENT DOCUMENTS

| | | |
|---|---|---|
| 1039921 | 9/1978 | Canada . |
| 447969 | 9/1991 | European Pat. Off. . |
| 2090150 | 3/1990 | Japan . |
| 22945 | 1/1992 | Japan . |
| 91/08515 | 6/1991 | WIPO . |

*Primary Examiner*—Lee C. Wright
*Attorney, Agent, or Firm*—Arthur E. Kluegel

[57] ABSTRACT

The invention provides a photographic element comprising a support bearing a blue-light sensitive silver halide emulsion layer containing an acylacetanilide yellow image dye-forming coupler having formula I or II:

I

II wherein:

$R_a$ is a substituted or unsubstituted alkyl, alkoxy, or aryloxy group;

$R_b$ is a substituted or unsubstituted alkyl or aryl group;

$R_c$ is hydrogen or a substituted or unsubstituted alkyl group;

$R_1$ is a substituent;

n is an integer from 0 to 2;

$R_2$ is selected from the group consisting of halogen, trifluoromethyl, and substituted or unsubstituted alkoxy and aryloxy;

$R_3$ is a substituted or unsubstituted alkyl group;

$R_4$ is hydrogen, halogen, alkoxy carbonyl (—$CO_2R$), carbamoyl (—CONRR'), carbonamido (—NRCOR'), sulfonamido (—$NRSO_2R'$) or trifluoromethyl; $R_1$ is a substituent;

X is hydrogen or a coupling-off group;
wherein said blue-light sensitive silver halide emulsion layer is a low-chloride silver halide emulsion.

The invention enables improved image quality through increased interimage effects.

24 Claims, No Drawings

PHOTOGRAPHIC ELEMENT CONTAINING A CERTAIN SULFONATED ACYLACETANILIDE COUPLER IN COMBINATION WITH LOW- OR NON-CHLORIDE EMULSIONS

FIELD OF THE INVENTION

This invention relates to photographic materials comprising a certain sulfonate-substituted acylacetanilide yellow dye-forming coupler and a low-or non-chloride silver halide emulsion. The emulsion may be all silver bromide or silver bromide with a minor percentage of silver iodide. It also relates to methods for improving the yellow dye-forming ability of photographic materials comprising such combinations.

BACKGROUND OF THE INVENTION

In a silver halide color photographic material a color image is formed when the element is exposed to light and then subjected to color development. The color development results in imagewise reduction of silver halide and production of oxidized primary amine developer. The oxidized primary amine developing agent subsequently reacts with one or more incorporated dye-forming couplers to form dye in an imagewise fashion.

Photographic materials employing silver halide emulsions with a high chloride content are often readily developable and can lead to dye formation with high efficiency. Silver bromide, silver bromoiodide and other low-chloride emulsions can have superior photographic speed and resistance to fogging but are usually less readily developable. The rate or extent of development of such emulsions can be sensitive to the nature of the couplers incorporated in the photographic material, since the reactivity of the couplers can influence the local concentrations of oxidized developer, which in turn can influence the local reducing power of the developer solution. Many yellow dye-forming couplers that have been used in the art have low reactivity with oxidized developer. This can lead to inefficient dye formation, due to both decreased silver development and due to low efficiencies for scavenging oxidized developer by the coupler.

It would be desirable to have yellow-dye forming couplers that result in higher dye-formation efficiencies, particularly in photographic materials comprising silver bromide emulsions, silver bromoiodide emulsions or other silver halide emulsions with low chloride content. It is at the same time desirable to provide a yellow dye that has acceptable hue and good stability to heat and light.

There are many references to yellow dye-forming couplers in the art. Among them are U.S. Pat. Nos. 3,973,968 of Fujihara et al, 4,022,620 of Okumura et al and 5,066,574 of Kubota et al, which disclose the synthesis and use of yellow dye-forming couplers with hydantoin derivatives as coupling-off groups and Canadian Patent 1,039,291 which discloses yellow dye-forming couplers with oxazolidine-2,4-dione coupling-off groups.

U.S. Pat. No. 5,066,574 of Kubota et al discloses acylacetanilide yellow-dye forming couplers with sulfonate substituents, among many other substituents. International Patent WO 91/08515 of Leyshon et al discloses a sulfonate substituted pivaloylacetanilide coupler (coupler 6), among other couplers, in combination with high-chloride silver halide emulsions and bisphenol compounds. U.S. Pat. No. 4,026,709 of Piller et al discloses specific acylacetanilide yellow dye-forming couplers with sulfonate substituents, among other substituents. European Patent Application 447,969 of Shimura et al discloses a cyclic acylacetanilide yellow dye-forming coupler with a sulfonate substituent. None of these patent publications disclose the use of the particular sulfonate substituted acylacetanilide yellow dye-forming imaging coupler of the invention in a low- or non-chloride silver halide emulsion layer nor do any of them disclose the unexpected advantages associated with such conjoint usage.

It is a problem to be solved to provide a photographic element having a blue-light sensitive layer containing a yellow dye-forming image coupler exhibiting better yellow dye-forming properties than those heretofore known.

SUMMARY OF THE INVENTION

The invention provides a photographic element comprising a support bearing a blue-light sensitive silver halide emulsion layer containing an acylacetanilide yellow image dye-forming coupler having formula I or II:

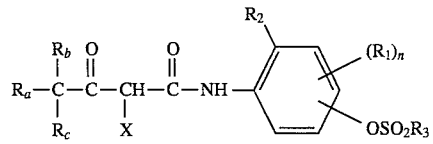

I

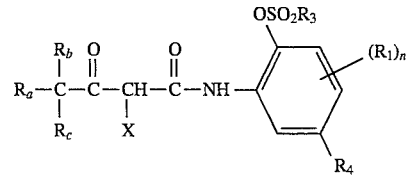

II wherein:

$R_a$ is a substituted or unsubstituted alkyl, alkoxy, or aryloxy group;

$R_b$ is a substituted or unsubstituted alkyl or aryl group;

$R_c$ is hydrogen or a substituted or unsubstituted alkyl group;

$R_1$ is a substituent;

n is an integer from 0 to 2;

$R_2$ is selected from the group consisting of halogen, trifluoromethyl, and substituted or unsubstituted alkoxy and aryloxy;

$R_3$ is a substituted or unsubstituted alkyl group;

$R_4$ is hydrogen, halogen, alkoxy carbonyl (—$CO_2R$), carbamoyl (—CONRR'), carbonamido (—NRCOR'), sulfonamido (—$NRSO_2R'$) or trifluoromethyl;

X is hydrogen or a coupling-off group;

wherein said blue-light sensitive silver halide emulsion layer is a low-chloride silver halide emulsion. The invention also provides a method of forming an image in such an element.

The element of the invention provides efficient formation of yellow dye so that improved dye density and correlative advantages may be realized.

DETAILED DESCRIPTION OF THE INVENTION

The photographic element of the invention comprises a blue-light sensitive silver halide emulsion layer containing an acylacetanilide yellow image dye-forming coupler having formula I or II:

I

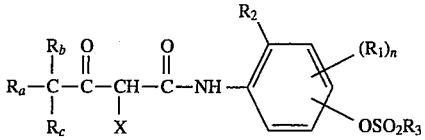

II

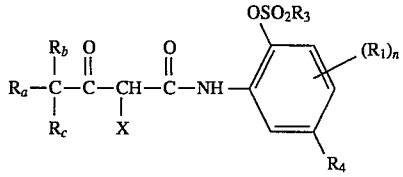

wherein:

$R_a$ is a substituted or unsubstituted alkyl, alkoxy, or aryloxy group, suitably containing up to 42 carbon atoms, such as a methyl, ethyl, propyl, butyl, pentyl, hexyl, octyl, dodecyl, hexadecyl, methoxy, or phenoxy group. When $R_a$ is a substituted alkyl group, suitable substituents may include, for example, alkoxy, phenoxy and phenyl groups.

$R_b$ is a substituted or unsubstituted alkyl or aryl group, suitably containing up to 42 carbon atoms, such as a methyl, ethyl, propyl, butyl, pentyl, hexyl, octyl, dodecyl, hexadecyl, or phenyl group.

$R_c$ is hydrogen or a substituted or unsubstituted alkyl group;

$R_1$ is a substituent as defined hereafter;

n is an integer from 0 to 2;

$R_2$ is halogen, such as chlorine or fluorine, trifluoromethyl, or a substituted or unsubstituted alkoxy or aryloxy group, such as methoxy, ethoxy, etradecyloxy, and phenoxy;

$R_3$ is a substituted or unsubstituted alkyl group;

$R_4$ is hydrogen, halogen, alkoxy carbonyl (—$CO_2R$), carbamoyl (—CONRR'), carbonamido (—NRCOR'), sulfonamido (—$NRSO_2R'$) or trifluoromethyl where R and R' are substituted or unsubstituted alkyl groups;

X is hydrogen or a coupling-off group examples of which include, chlorine, an aryloxy group, an alkoxy group, a ballasted arylthio or alkylthio group, a carbamate group, an acyloxy group, a carbonamido group, a sulfonamido group, or a nitrogen-containing heterocyclic group, such as pyrazolyl, imidazolyl, succinimido, hydantoinyl or oxazolidine-2,4-dionyl group.

X may also be a photographically useful coupling-off group that can advantageously affect the layer in which the coupler is coated or other layers of the photographic material. Photographically useful X groups include inhibitors (forming DIR couplers), switched or timed inhibitors, bleach accelerators (such as 3-mercaptopropionic acid), development accelerators and chromophore groups that form colored masking couplers.

It is contemplated that the coupling-off group be selected with the imaging aspects of the coupler and subsequently formed dye primarily in mind. Coupling-off groups containing photographically useful groups such as development inhibitors, bleach accelerators etc. as a primary function, while usable, are not contemplated as coupling-off groups of primary concern for this image coupler. Generally preferred for X are nitrogen containing heterocyclic coupling-off groups, particularly those of formulas III and IV, defined below:

III

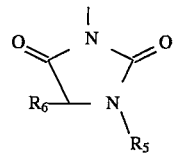

IV

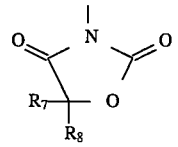

wherein:

$R_5$ is a substituted or unsubstituted alkyl group (including an arylalkyl group, such as benzyl); examples of suitable alkyl groups are methyl, ethyl, propyl, isopropyl, butyl, hexyl, cyclohexyl, octyl and dodecyl.

$R_6$ is hydrogen or a substituted or unsubstituted alkyl group or alkoxy group and is preferably a hydrogen or alkoxy group, most preferably a hydrogen; examples of suitable groups are methyl, ethyl, hexyl, methoxy, ethoxy and butoxy.

$R_7$ and $R_8$ are individually hydrogen or substituted or unsubstituted alkyl. Preferably at least one of $R_7$ and $R_8$ is an alkyl group.

References to groups, such as alkyl, aryl, alkoxy and alkoxycarbonyl groups, are intended to include both unsubstituted and substituted groups. References to aliphatic groups, such as alkyl or alkoxy, include unbranched, branched and cyclic groups.

As used herein, the term substituent, unless otherwise specifically stated, has a broad definition. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido;

sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl] carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 30 carbon atoms and usually less than 24 carbon atoms, but greater numbers are possible depending on the particular substituents selected. Moreover, as indicated, the substituents may themselves be suitably substituted with any of the above groups.

In the most preferred embodiment, each of $R_a$, $R_b$, and $R_c$ is alkyl and all may conveniently be methyl.

To minimize water solubility and coupler wandering the total number of carbon atoms contained in $R_a$, $R_b$, $R_c$, $R_1$, $R_2$, $R_3$, $R_4$, and X taken together (it being understood that for formula I there is no $R_4$ and for formula II there is no $R_2$) should be at least 12 and preferably from about 14 to 45. To minimize dye wandering the total number of carbon atoms in $R_a$, $R_b$, $R_c$, $R_1$, $R_2$, $R_3$, and $R_4$ taken together should be at least 9.

Examples of sulfonate-substituted acylacetanilide yellow-dye forming couplers useful for the practice of this invention include, but are not limited to the following (I1-I27):

I1

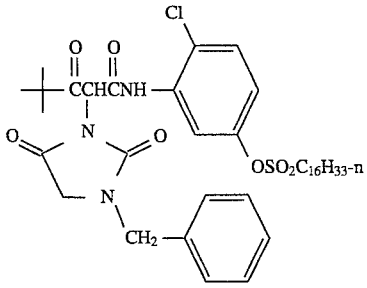

I2

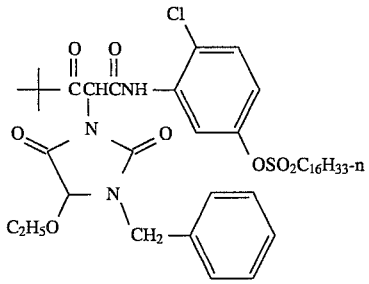

I3

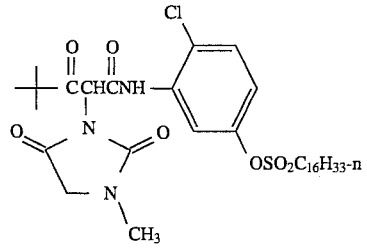

I4

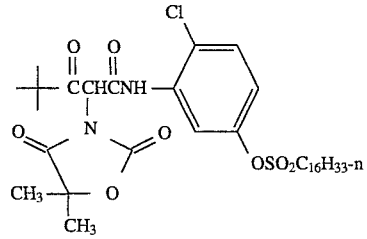

I5

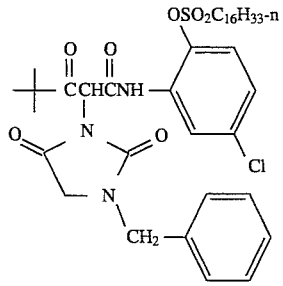

I6

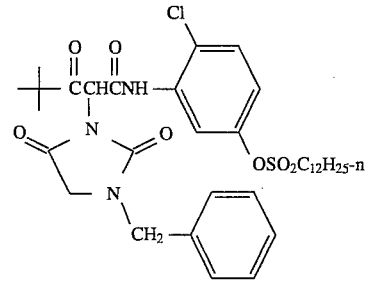

-continued
I7
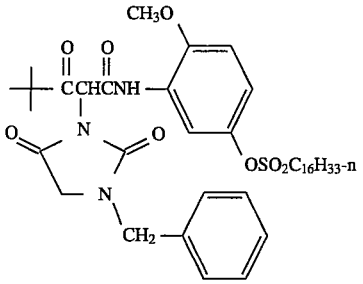
I8
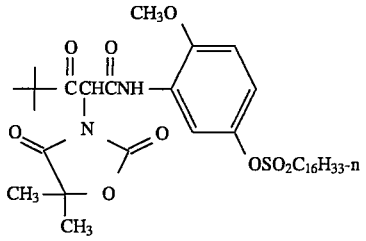
I9
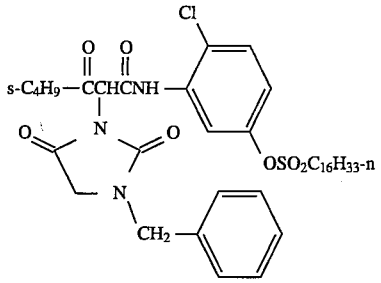
I10
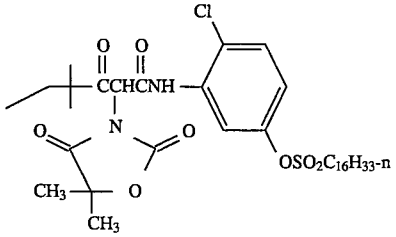
I11
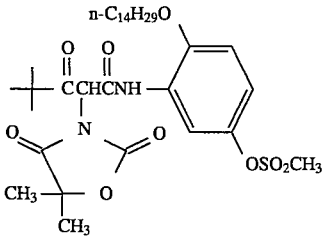
-continued
I12
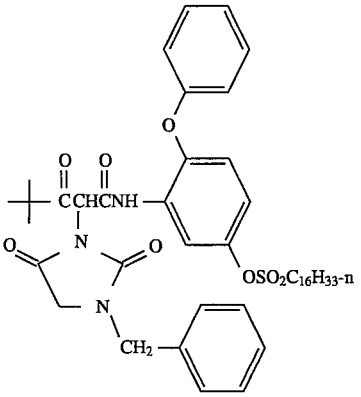
I13
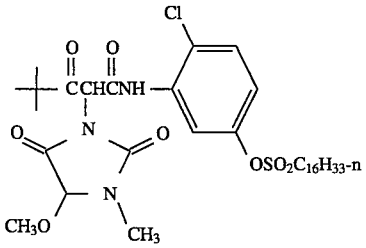
I14
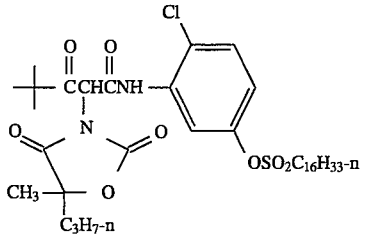
I15
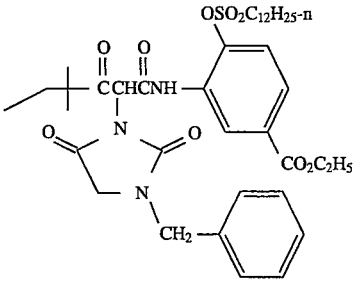
I16
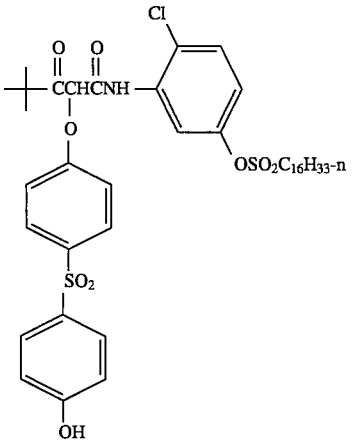

-continued
I17
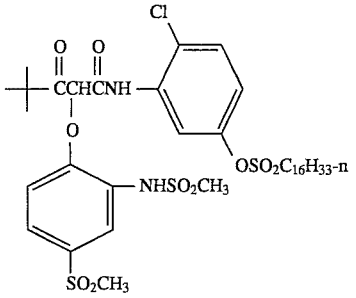
I18
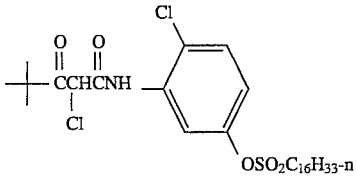
I19
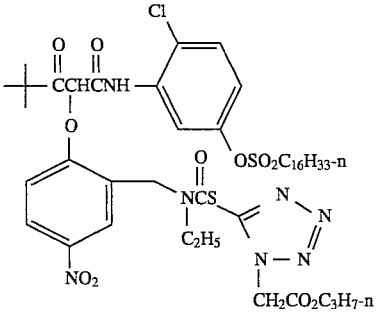
I20
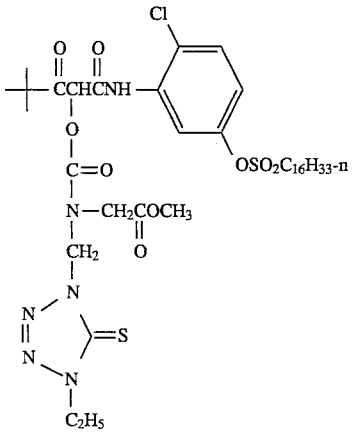
I21
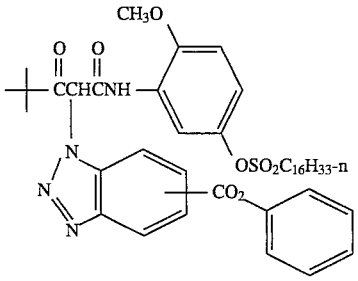
-continued
I22
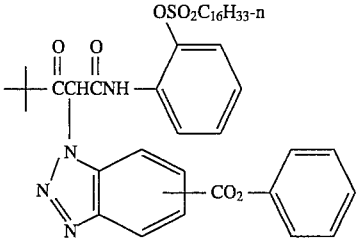
I23
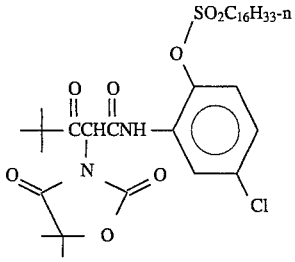
I24
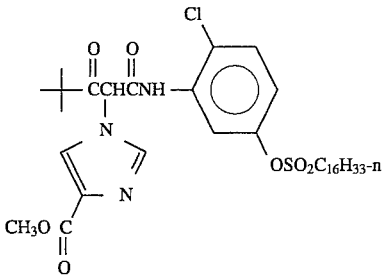
I25
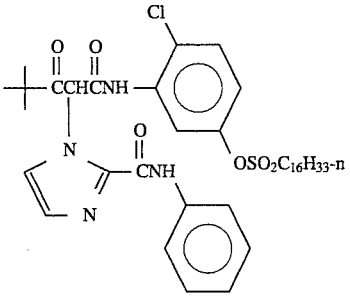
I26
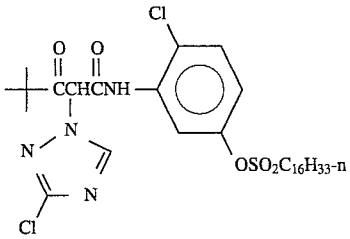
I27
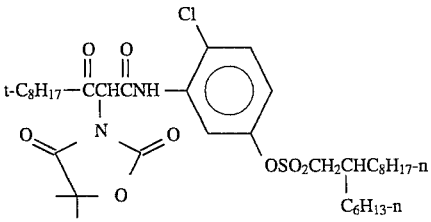

References to groups, such as alkyl, aryl, alkoxy and alkoxycarbonyl groups, include both unsubstituted and substituted groups. References to aliphatic groups, such as alkyl or alkoxy, include unbranched, branched and cyclic groups.

Useful coated levels of the yellow-dye forming couplers of this invention range from about 0.01 to 3.0 g/sq m, depending on the function of the coupling-off group. Yellow dye-forming imaging couplers of this invention are typically coated at levels ranging from 0.05 to 2.0 g/sq m.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanilide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred.

The invention provides photographic materials in which the yellow dye-forming coupler has high reactivity and forms dye with high efficiency when used in combination with silver halide emulsions having low (<25%) silver chloride content. The invention also provides photographic materials in which continued coupling is low in photographic processes that do not employ a stop bath between the development and bleach or bleach-fix steps. The invention provides photographic materials in which the yellow dye-forming couplers yield dyes of the proper hue upon reaction with oxidized developer and in which the chromogenically-produced yellow dyes have good stability, especially good stability toward heat.

The silver halide emulsions of this invention comprise silver bromide emulsions, silver bromoiodide emulsions (predominantly bromide) and other low-chloride emulsions in which the chloride constitutes less than 25 mole percent of the total halide. "Low" chloride as used herein means less than 25 mole % of the silver halide present in the layer where the yellow dye-forming coupler is located and is meant to include the layers that are free of or substantially free of silver chloride. The yellow dye-forming coupler and silver halide combinations of this invention may be used with a variety of other types of couplers in the same or different layers. Specifically contemplated is the use of the yellow-dye forming coupler silver halide combinations of this invention in one or more blue sensitive layers together with one or more green sensitive layers containing at least one two-equivalent 1-phenyl-3-anilino-5-pyrazolone magenta dye-forming coupler.

The materials of the invention can be used in any of the ways and in any of the combinations known in the art. Typically, the invention materials are incorporated in a silver halide emulsion and the emulsion coated as a layer on a support to form part of a photographic element.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 publishedby Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or maminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1 -imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4 -bis(1,1-dimethylpropyl)phenoxy]acetyl]amino]-5-[(2,2,3,3,4,4,4-heptafluoro-1-oxobutyl)amino]-4-hydroxyphenoxy] -2,3-dihydroxy-6-[(propylamino)carbonyl] phenyl]thio]-1,3,4-thiadiazol-2-yl]thio]-, methyl ester and "Coupler 3": 1-((dodecyloxy)carbonyl)ethyl( 3-chloro-4-((3-(2-chloro-4-((1-tridecanoylethoxy)carbonyl)anilino)-3-oxo-2-((4)(5)(6)-(phenoxycarbonyl)- 1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-( 4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-( 4',5'-dihydro-5'-oxo-1'-(2,4,6-trichlorophenyl)(1,4' -bi-1H-pyrazol)-3'-yl)-, "Coupler 6": Carbamic acid, (6- (((3-(dodecyloxy)propyl)amino)carbonyl)-5-hydroxy-1 -naphthalenyl)-, 2-methylpropyl ester , "Coupler 7": Acetic acid, ((2-((3-(((3-(dodecyloxy)propyl)amino)carbonyl)-4-hydroxy-8-(((2 -methylpropoxy)carbonyl)amino)- 1-naphthalenyl)oxy)ethyl)thio)-, and "Coupler 8" Benzamide, 3-((2-(2,4-bis(1,1-dimethylpropyl)phenoxy)- 1-oxobutyl)amino)-N-(4,5-dihydro-4-((4-methoxyphenyl)azo)- 5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)- 4,5-dihydro-5-oxo-1H-pyrazol-3-yl]-2-methyl-2-propenamide; and "Coupler 10": Tetradecanamide, N-(4-chloro-3 -((4-((4-((2,2-dimethyl-1 -oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1 -dimethylpropyl)phenoxy)propyl)amino)carbonyl)-4 -hydroxy-1-naphthalenyl)oxy)ethoxy)phenyl)azo)-4 -hydroxy-, disodium salt; and a slow cyan layer containing Couplers 2 and 6;

(7) an undercoat layer containing Coupler 8; and (8) an antihalation layer.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4 -(1-(((2-chloro-5-((dodecylsulfonyl)amino)phenyl)amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl] -4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)- 4,5-dihydro-5-oxo-1H-pyrazol-3-yl]-2-methyl-2-propenamide; "Coupler 4": Benzamide, 3-((2-(2,4 -bis(1,1-dimethylpropyl)phenoxy)-1-oxobutyl)amino)-N-(4,5-dihydro-5-oxo-1-(2,4,6-trichlorophenyl)-1 H-pyrazol-3-yl)-; and "Coupler 5": Benzamide, 3-(((2,4 -bis(1,1-dimethylpropyl)phenoxy)acetyl)amino)-N-(4,5 -dihydro-5-oxo-1-(2,4,6-trichlorophenyl)-1H-pyrazol-3 -yl)-; and containing the stabilizer 1,1'-Spirobi(1H-indene), 2,2',3,3'-tetrahydro-3,3,3',3'-tetramethyl- 5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2 -cyanophenoxy)-N-(4-((2,2,3,3,4,4,4-heptafluoro-1 -oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2- hydroxyphenyl)-2,2,3,3,4,4,4-heptafluoro- and "Coupler 8": Hexanamide, 2-(2,4-bis(1,1-dimethylpropyl)phenoxy)-N-( 4-((2,2,3,3,4,4,4-heptafluoro-1-oxobutyl)amino)-3 -hydroxyphenyl)-;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non colorforming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

"Development Inhibitor-Releasing" compounds (DIR's) useful in conjunction with the compositions of the invention are known in the art and examples are described in U.S. Pat. Nos. 3,137,578; 3,148,022; 3,384,657; 3,379,529; 3,615,506; 3,148,062; 3,227,554; 3,701,783; 3,733,201; 4,049,455; 3,617,291; 3,620,746; 4,149,886; 4,150,228; 4,211,562; 4,095,984; 4,126,459; 4,362,878; 4,409,323; 4,477,563; 4,248,962; 4,259,437; 4,500,634; 4,579,816; 4,607,004; 4,782,012; 4,962,018; 4,746,600; 4,746,601; 4,791,049; 4,618,571; 4,678,739; 4,880,342; 4,886,736; 4,937,179; 4,857,447; 4,865,959; 4,952,485; 4,956,269; 4,959,299; 4,946,767; 4,948,716; 4,985,336 as well as in patent publications 4,966,835; GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C.R. Barr, J.R. Thirtle and P.W. Vittum in *Photographic Science* and *Engineering*, vol. 13, p. 174 (1969), incorporated herein by reference.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above.

The element of the invention is suitably used with a bromoiodide or other low- or non-chloride silver halide emulsion. Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any substitutent that does not harm the photographic properties of the element. Usually the further substituent will have less than 30 carbon atoms and typically less than 20 carbon atoms.

Synthesis of the yellow dye-forming coupler of the invention is well-known in the art. They may be made, for example, by condensing a suitably substituted aniline with methyl pivaloyl acetate (MPA) in a high boiling point solvent such as n-heptane during which methanol is removed azeotropically.

The coupling-off group is attached to the 4-equivalent parent coupler via the intermediacy of a chloro derivative which is obtained by treating the parent coupler with a suitable chlorinating agent such as sulfuryl chloride. The chloro substituent is then displaced by the anion of the coupling-off group. This conversion can be undertaken in a polar solvent such as acetonitrile using an organic base such as triethylamine to ionize the coupling-off group. U.S. Pat. No. 4,022,620 discloses this methodology and is incorporated herein by reference.

The sulfonated acylacetanilide yellow dye-forming imaging coupler and low chloride emulsion combinations of this invention may be used together with a variety of other types of couplers in the same layer or in different layers of a multilayer photographic material. Specifically contemplated is the use of combinations of this invention together with one or more benzoylacetanilide yellow dye-forming imaging couplers, such as those described in U.S. Pat. Nos. 3,973,968 or 4,022,620 in the same layer or in an adjacent layer. Also specifically contemplated is the use of the combinations of this invention in one or more blue sensitive layers together with one or more green sensitive layers containing at least one two-equivalent 1-phenyl-3-anilino-5-pyrazolone magenta dye-forming coupler.

The synthesis of yellow dye-forming acylacetanilide coupler I1 of this invention is outlined schematically below and described in the subsequent paragraphs.

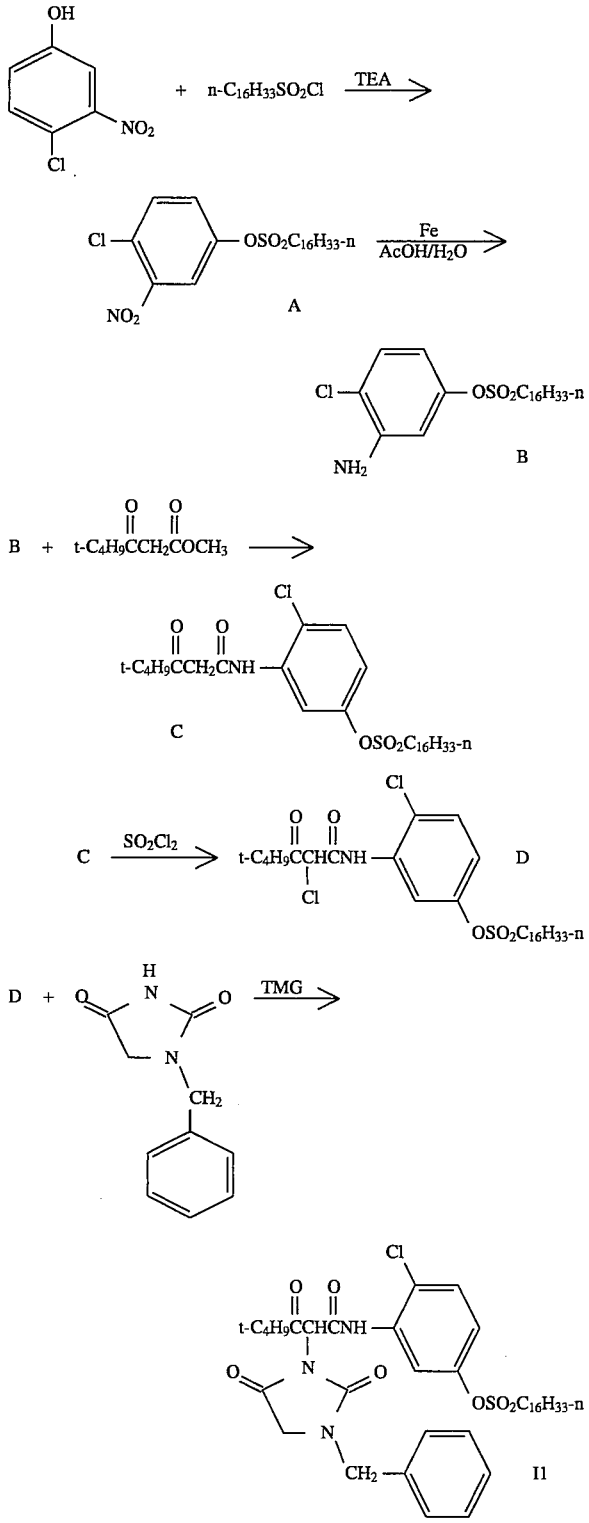

Compound A:

To a solution of 121.2 g (0.7 mol) of 4-chloro-3-nitrophenol and 75.3 g (0.7 mole) of triethylamine in 350 mL of tetrahydrofuran was added dropwise a solution of 226.5 g (0.7 mol) of hexadecylsulfonyl chloride in 600 mL of tetrahydrofuran, while stirring and maintaining the temperature at <30° C. in an ice bath. The mixture was poured into a stirred solution of 8.5 L of 10% HCl. The precipitate that formed was filtered off and dissolved in 3 L of ethyl acetate and the retained water was removed using a separatory funnel. The solution was concentrated to 800 mL by evaporation of ethyl acetate, filtered, washed with ethyl acetate and dried. The product consisted of 229.5 g (71%) of a solid confirmed to be A by elemental analysis.

Compound B:

To a heated and stirred solution of 229.5 g (0.447 mol) of A in 640 mL of acetic acid and 60 mL of water was slowly added 111.3 g (1.968 mol) of iron powder. The mixture was then refluxed for 30 min. The iron was filtered off while the mixture was still hot. Hot acetic acid (about 600 mL) was poured through the filter funnel to remove additional product from the residue. The filtrate was poured into 15 L of water, stirred for 1 hr and filtered. The precipitate that formed was slurried in 4 L of water, filtered and dried. The product, consisting of 200.2 g (93.9%) of a pale yellow solid, was identified as B by elemental analysis.

Compound C:

A solution of 200.2 g (0.463 mol) of B and 80 g (0.51 mol) of methylpivaloyl acetate in 1 L of xylene was refluxed (with a Dean-Stark bleed) for 6 hr. The solution was concentrated to 400 mL, cooled, and filtered. The precipitate was washed with a small amount of xylene, then with 500 mL of petroleum ether (60/80), filtered and dried to yield 173.3 g of a single product (by TLC) corresponding to C based on elemental analysis. The filtrate was evaporated to an oil, which was slurried in petroleum ether, allowed to stand overnight and filtered and dried to yield an additional 59.3 g of C (232.6 g total or 90% yield).

Compound D:

To a stirred solution of 172.3 g (0.31 mol) of C in 800 mL of dichloromethane was added dropwise a solution of 41.9 g (0.31 mol) of sulfuryl chloride in 200 mL of dichloromethane. The solution was stirred at room temperature overnight and then concentrated to an oil on a rotary evaporator. Then 500 mL of petroleum ether was added, and the mixture was warmed. The mixture was then filtered and dried to yield 175.4 g (95.5% yield) of a white powder identified as D by elemental analysis.

Inventive Coupler I1:

To a stirred solution of 95.3 g (0.161 mol) of D and 30.59 g (0.161 mol) of N-benzylhydantoin in 600 mL of acetonitrile was added dropwise 40.3 g (0.35 mol) of tetramethyl guanidine. The mixture was stirred for 25 hr, after which no starting material was observed by TLC. The reaction mixture was poured into 3.5 L of 5% HCl and stirred for 1 hr. The precipitate that formed was filtered, and washed with 5 L of water and dried. The product, which showed some impurities by TLC, was dissolved in 500 mL of ethyl acetate, dried over magnesium sulfate and concentrated to dryness. The yellow oil obtained was dissolved in 500 mL of petroleum ether, stirred and seeded with precipitate from the prior step. The precipitate that formed was filtered and washed with petroleum ether. The precipitate was then slurried in 600 mL of hot petroleum ether, cooled, filtered, washed with petroleum ether and dried under vacuum at 50° C. The product, a white crystalline solid (MP=76°–77° C.), was identified as coupler I1 by elemental analysis (see below). The yield was 87.09 g or 72.6% and HPLC analysis indicated a purity of 100%.

| Elemental Analysis of I1 | | | | | |
|---|---|---|---|---|---|
| Calculated: | C = 62.76, | H = 7.66, | Cl = 4.75, | N = 5.63, | S = 4.30 |
| Found: | C = 62.74, 62.69 | H = 7.58, 7.58, | Cl = 4.99, | N = 5.62, 5.61 | S = 4.19 |

One way to measure coupler reactivity is to compare dye formation efficiencies in the presence and absence of a species that competes with the coupler for oxidized developer. A competing species that either forms no dye or that forms a dye that is not retained in a processed film is preferred. In subsequent examples the competing coupler citrazinic acid (CZA) is used. The dye formed from CZA is not retained in the film.

EXAMPLE 1

Comparative Evaluation of Coupler of The Invention in Combination with a Silver Bromoiodide Emulsion To illustrate the advantages of the acylacetanilide/silver halide combinations of this invention, coatings of inventive and comparative couplers and a silver bromoiodide (3.5% iodide) emulsion were prepared on a transparent support. Aqueous dispersions of the couplers were first prepared by adding an oil phase containing 2.25 g of coupler, 2.25 g of the high-boiling solvent S1 (di-n-butylphthalate) and 6.75 g of ethyl acetate to a solution of 3.0 g of gelatin and 0.3 g of the sodium salt of tri-isopropylnaphthalene sulfonic acid (a dispersing agent) in sufficient water to yield a total volume of 50 mL. Each of the resulting mixtures was then passed through a colloid mill to disperse the coupler-containing oil phase in the aqueous gelatin phase as small particles. The resulting dispersions contained 4.5 percent by weight of coupler.

Sufficient coupler dispersion to yield a laydown of 0.00215 mole/sq m was mixed with emulsion and additional gelatin and coated on cellulose acetate butyrate support as diagrammed below. The ethyl acetate in the dispersions evaporates on drying. The chemically-sensitized, silver bromoiodide emulsion was coated at a laydown of 0.755 g Ag/sq m. The layer containing coupler and silver halide was overcoated with a layer containing gelatin and the hardener bis(vinylsulfonylmethyl) ether as shown in the diagram below.

2.69 g/sq m Gelatin (overcoat)
0.129 g/sq m Bis(vinylsulfonylmethyl) Ether Hardener
3.77 g/sq m Gelatin
0.00215 mole/sq m Acylacetanilide Coupler
Di-n-butylphthalate at Equal Weight to Coupler
0.755 g Ag/sq m as a Silver Bromoiodide (3.5% Iodide) Emulsion
Cellulose Acetate Butyrate Support After the films had hardened they were exposed through a step tablet on a 1B sensitometer and then subjected to a modified KODAK FLEXICOLOR C-41 color negative process, as described in more detail below. Gamma values were obtained from plots of Status M blue density vs log exposure both without and with 4.0 g/L of the competing coupler citrazinic acid added to the developer. The ratio of gamma with CZA (Gamma CZA) to Gamma without CZA (Gamma) is a measure of the activity of the yellow dye-forming coupler. Values of this ratio are included in Table II. Values of the spectral absorption maxima (Lambda max) obtained using a Sargent-Welch PU8800 spectrophotometer are also listed in Table II.

| C-41 PROCESSING SOLUTIONS AND CONDITIONS | | |
|---|---|---|
| Solution | Processing Time | Agitation Gas |
| A) C-41 Developer | 2' | Nitrogen |
| or B) C-41 Developer with 4.0 g/L of CZA | 2' | Nitrogen |
| ECN Stop Bath | 30" | Nitrogen |
| Wash | 2 | None |
| Bleach III | 3' | Air |
| Wash | 3' | None |
| C-41 Fix | 4' | Nitrogen |
| Wash | 3' | None |
| PHOTO-FLO | 30" | None |
| Processing Temperature = 100° F. | | |

TABLE II

| Coupler (in S1 @ 1:1) | Gamma | Gamma CZA/ Gamma | Lambda max (in nm) |
|---|---|---|---|
| C1-Comparative | 1.69 | 0.58 | 450 |
| C2-Comparative | 1.69 | 0.50 | 452 |
| C3-Comparative | 1.46 | 0.53 | 454 |
| C4-Comparative | 1.35 | 0.45 | 449 |
| C5-Comparative | 1.65 | 0.55 | 448 |
| I1-Invention | 1.94 | 0.62 | 454 |
| I2-Invention | 1.90 | 0.63 | 453 |
| I3-Invention | 1.74 | 0.66 | 453 |
| I4-Invention | 2.07 | 0.67 | 453 |

Formulas for the additional comparative couplers in Table II are given below. It can be seen from the Gamma values and the Gamma CZA/Gamma ratios in Table II that the sulfonate couplers I1—I4 of this invention are more active and yield higher dye densities at equal molar laydowns than the comparative couplers C1–C5 with similar coupling-off groups. The lambda max values obtained with the couplers of this invention are also in the desired region of approximately 450 nm. Additional measurements have indicated that the couplers of this invention give low continued coupling and yield dyes with excellent thermal stability.

C1

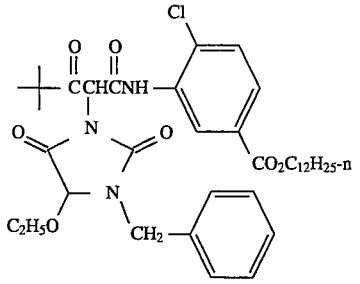

C2

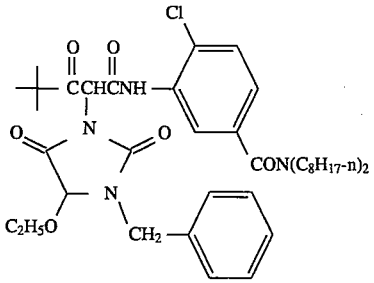

C3

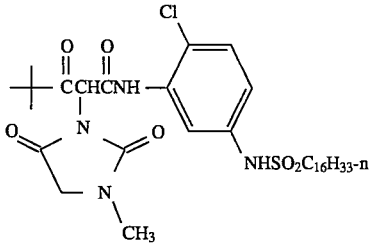

C4

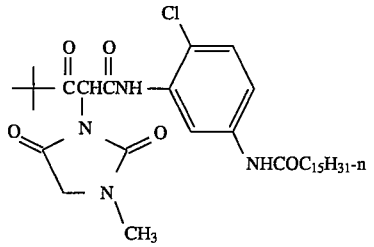

C5

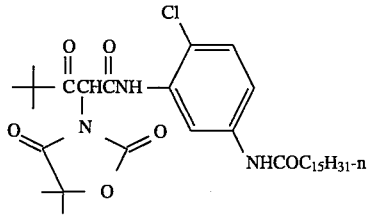

The preceding examples are set forth to illustrate specific embodiments of this invention and are not intended to limit the scope of the materials or combinations of this invention. Additional embodiments and advantages within the scope of the claimed invention will be apparent to one skilled in the art.

What is claimed is:

1. A photographic element comprising a support bearing a blue-light sensitive silver halide emulsion layer containing an acylacetanilide yellow image dye-forming coupler having formula I or II:

I

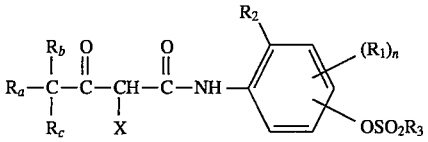

II

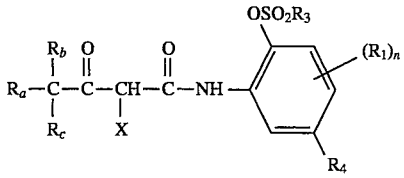

wherein:

$R_a$ is an alkyl, alkoxy, or aryloxy group;

$R_b$ is an alkyl or aryl group;

$R_c$ is hydrogen or an alkyl group;

$R_1$ is a substituent;

n is an integer from 0 to 2;

$R_2$ is selected from the group consisting of halogen, trifluoromethyl, and substituted or unsubstituted alkoxy and aryloxy;

$R_3$ is an alkyl group;

$R_4$ is hydrogen, halogen, alkoxy carbonyl, carbamoyl, carbonamido, sulfonamido or trifluoromethyl;

X is hydrogen or a coupling-off group; wherein said blue-light sensitive silver halide emulsion layer is a low-chloride silver halide emulsion;

provided that each substituent $R_1$ is selected from the group consisting of and each $R_a$, $R_b$, $R_c$, $R_2$, $R_3$, $R_4$, and X having a substitutable hydrogen may be substituted with a substituent selected from the group consisting of halogen, nitro; hydroxyl; cyano; and carboxyl; alkyl; alkenyl; alkoxy; aryl; aryloxy; carbonamido; sulfonamido; sulfamoyl; carbamoyl; acyl; sulfonyl; sulfonyloxy; sulfinyl; thio; acyloxy; amine; imino; phosphate; phosphite; heterocyclic group, heterocyclic oxy group, or heterocyclic thio group each of which may be substituted and which contain a 3 to 7 membered heterocyclic ring composed of carbon atoms and at least one hetero atom selected from the group consisting of oxygen, nitrogen and sulfur; quaternary ammonium; and silyloxy, wherein said substituents may themselves be substituted with any of the above groups.

2. The photographic element of claim 1 wherein $R_a$, $R_b$, and $R_c$ are independently selected alkyl groups.

3. The photographic element of claim 2 wherein $R_a$, $R_b$, and $R_c$ are each a methyl group.

4. The photographic element of claim 1 wherein X is selected from the group consisting of aryloxy and heterocyclic groups which may be substituted as provided for $R_a$.

5. The photographic element of claim 4, wherein X is a heterocyclic coupling-off group having formula III or IV:

III

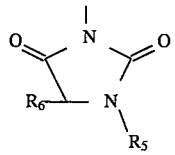

-continued

IV

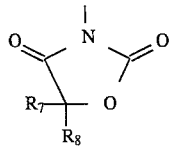

wherein:

$R_5$ is an alkyl group;

$R_6$ is selected from the group consisting of hydrogen, alkyl and alkoxy;

$R_7$ and $R_8$ are independently selected from the group consisting of hydrogen and alkyl wherein $R_5$, $R_6$, $R_7$, and $R_8$may be substituted as provided for $R_a$.

6. The photographic element of claim 5, wherein at least one of $R_7$ and $R_8$ is an unsubstituted alkyl group.

7. The photographic element of claim 6, wherein said at least one unsubstituted alkyl group is a methyl group.

8. The photographic element of claim 1, wherein $R_a$, $R_b$, $R_c$, $R_1$, $R_2$, $R_3$, $R_4$,and X, taken together for the applicable formula I or II, have at least 12 carbon atoms.

9. The photographic element of claim 1 wherein $R_a$, $R_b$, $R_c$, $R_1$, $R_2$, $R_3$, and $R_4$, taken together for the applicable formula I or II, have at least 9 carbon atoms.

10. The photographic element of claim 1, wherein the coated level of said coupler of formula I or II is 0.05 to 3.0 g/sq m.

11. The photographic element of claim 5, wherein $R_6$ is hydrogen or an alkoxy group which may be substituted as provided for $R_a$.

12. A photographic element of claim 11, $R_6$ is hydrogen.

13. The photographic element of claim 5, wherein at least one of $R_7$ and $R_8$ is an alkyl group which may be substituted as provided for $R_a$.

14. The photographic element of claim 13, wherein $R_7$ and $R_8$ are methyl.

15. The photographic element of claim 1, wherein $R_2$ is chloro and $R_3$ is n-hexadecyl.

16. The photographic element of claim 1, wherein the acylacetanilide yellow-dye forming imaging coupler has formula

I1

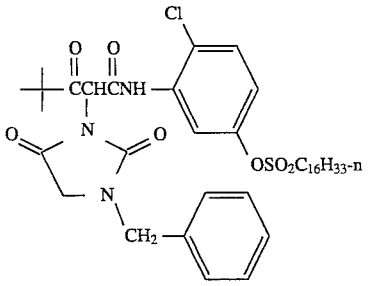

I2

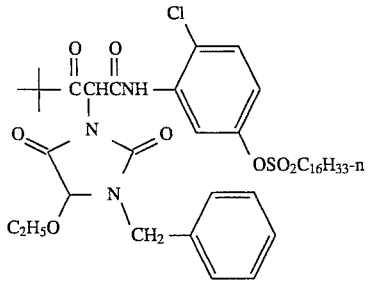

-continued

I3

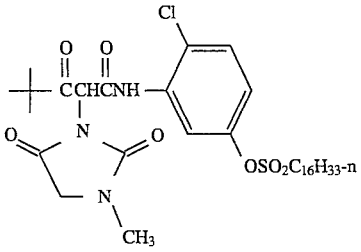

I4

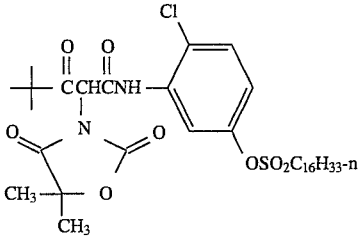

I5

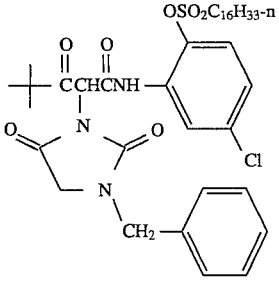

I6

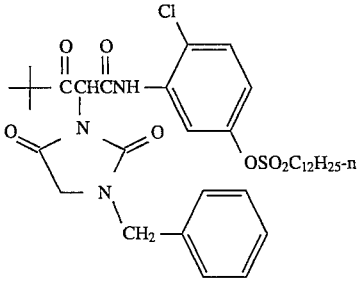

I7

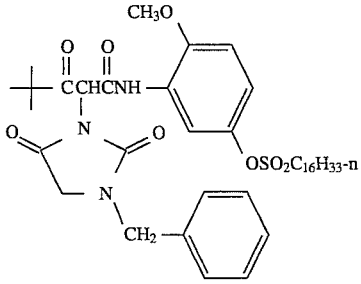

I8

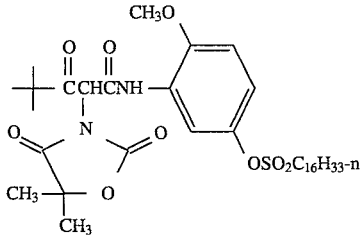

-continued
I9
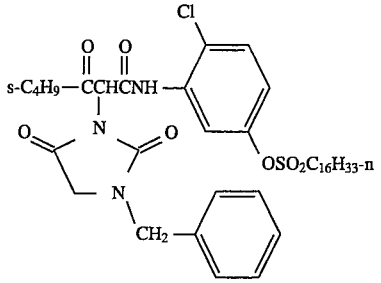
I10
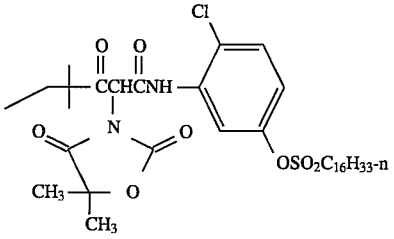
I11
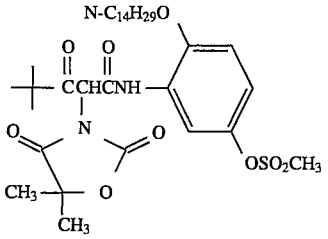
I12
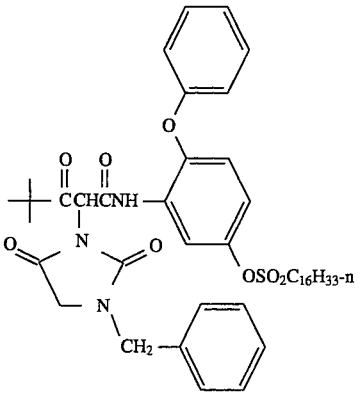
I13
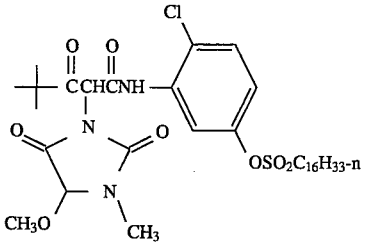
I14
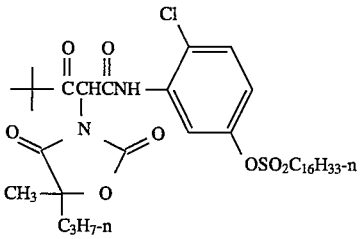
-continued
I15
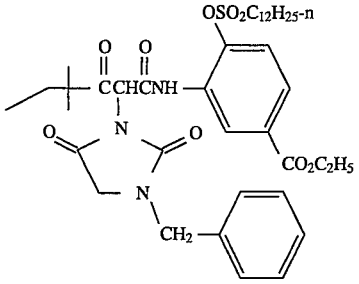
I16
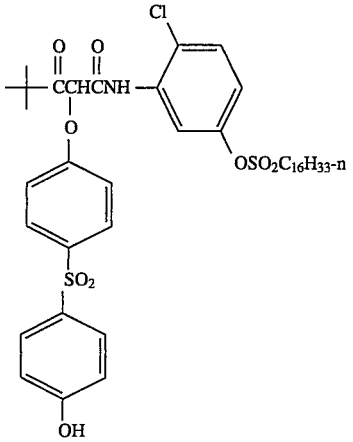
I17
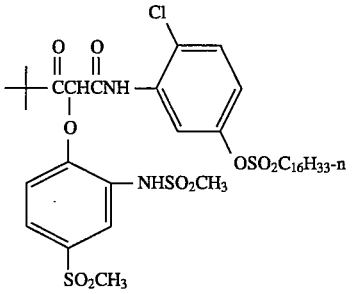
I18
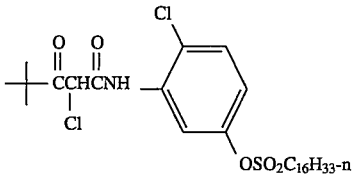
I19
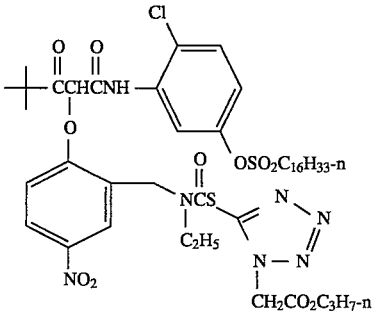

-continued

I20

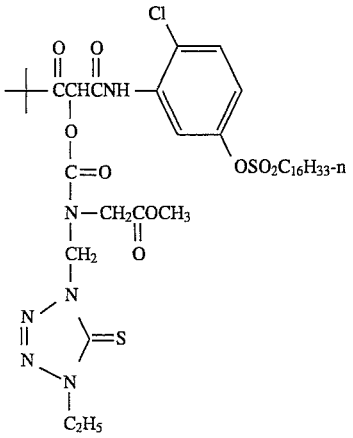

I21

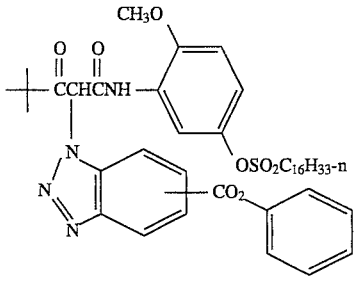

I22

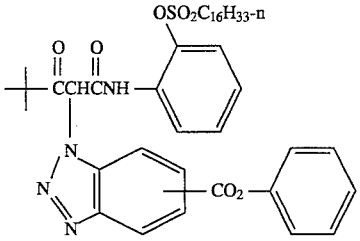

I23

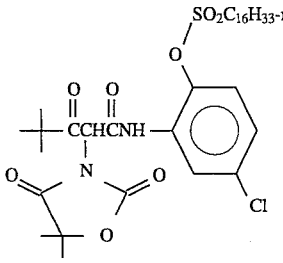

I24

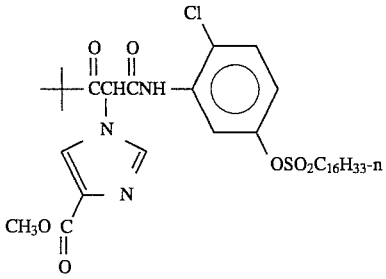

-continued

I25

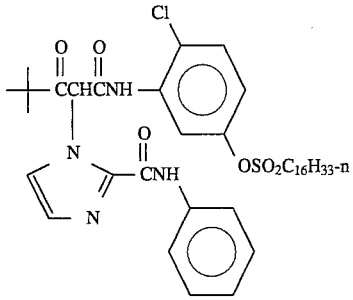

I26

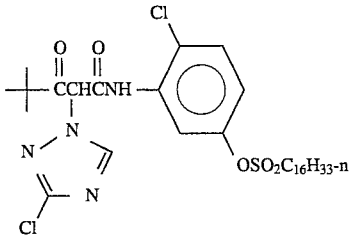

and

I27

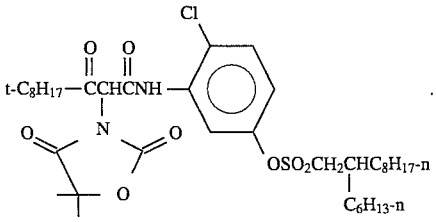

17. The photographic element of claim 1 wherein the blue-light sensitive silver halide emulsion has associated therewith a DIR coupler.

18. The element of claim 17 wherein the DIR coupler has the formula:

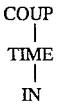

wherein:

COUP is a parent coupler moiety;

IN is an inhibitor moiety that is joined through a timing group and is released after COUP reacts with oxidized developer; and TIME is a timing group that is joined to the coupling site of COUP and allows delayed release of IN after the TIME-IN fragment is coupled off.

19. The photographic element of claim 17 wherein the coated level of the DIR coupler is 0.01 to 1.00 g/sq.m.

20. The photographic element of claim 1, additionally containing a benzoylacetanilide yellow dye-forming imaging coupler associated with the blue-light sensitive silver halide emulsion layer.

21. The photographic element of claim 1 wherein said blue-light sensitive silver halide emulsion layer contains silver halide comprising less than 5 mol % silver chloride.

22. The photographic element of claim 21 wherein said blue-light sensitive silver halide emulsion layer contains a predominant molar percentage of silver bromide and a lesser percentage of silver iodide.

23. The photographic element of claim 22 wherein said molar percentage of silver iodide is less than 15.

24. A method of forming an image in a photographic element as described in claim 1 which comprises exposing said element to light and thereafter developing the element with a color developer.

* * * * *